US009539485B1

(12) United States Patent
Snow

(10) Patent No.: US 9,539,485 B1
(45) Date of Patent: Jan. 10, 2017

(54) METHOD OF ANALYZING A GOLF SWING AND PRACTICE MAT

(71) Applicant: Eric George Snow, Boiling Springs, SC (US)

(72) Inventor: Eric George Snow, Boiling Springs, SC (US)

( * ) Notice: Subject to any disclaimer, the term of this patent is extended or adjusted under 35 U.S.C. 154(b) by 171 days.

(21) Appl. No.: 14/590,077

(22) Filed: Jan. 6, 2015

(51) Int. Cl.
*A63B 69/36* (2006.01)
*A63B 71/06* (2006.01)

(52) U.S. Cl.
CPC ..... *A63B 69/3617* (2013.01); *A63B 69/3661* (2013.01); *A63B 2071/0694* (2013.01)

(58) Field of Classification Search
CPC ..... A63B 69/3617; A63B 69/3661; A63B 2071/0694
See application file for complete search history.

(56) References Cited

U.S. PATENT DOCUMENTS 2,735,780 A * 2/1956 Le Comte ..... A01K 11/005 106/266
2,804,306 A * 8/1957 Chedister ..... A63B 69/3632 222/500
2,995,376 A * 8/1961 Leo ..... A63B 69/3632 346/19
3,311,377 A * 3/1967 Holbus ..... A63B 69/3632 473/237
3,687,459 A * 8/1972 Swords ..... A63B 69/3632 473/237
3,790,176 A 2/1974 Rietz
3,815,923 A 6/1974 Goduto
3,992,013 A * 11/1976 Golden ..... A63B 69/3632 473/237
4,434,983 A * 3/1984 Taggart ..... A63B 69/3667 273/291
4,932,662 A 6/1990 Blaisdell
5,028,052 A * 7/1991 Miller ..... A63B 69/3661 273/DIG. 31
5,120,064 A * 6/1992 Cerami ..... A63B 69/3632 473/237
5,120,358 A * 6/1992 Pippett ..... C09D 13/00 106/272
5,142,309 A 8/1992 Lee
5,609,530 A 3/1997 Butler, Jr.
5,620,376 A * 4/1997 Hsu ..... A63B 69/3632 473/233
6,106,409 A * 8/2000 Jackson, Jr. ..... A63B 69/3661 473/278
6,312,344 B1 * 11/2001 Smith ..... A63B 69/3617 473/237
6,361,449 B1 * 3/2002 Holly ..... A63B 24/0006 473/237
6,913,544 B2 * 7/2005 Tiffin ..... A63B 69/3661 473/257
7,448,956 B2 11/2008 Mitchell
7,594,858 B2 9/2009 Hauk
(Continued)

*Primary Examiner* — Raleigh W Chiu
(74) *Attorney, Agent, or Firm* — Monahan & Company, LLC; Timothy J. Monahan

(57) ABSTRACT

A method of practicing a golf swing and a kit for use with the method is provided, whereby the golfer applies a colorant to the sole of a golf club with a marking instrument and hits golf balls off of a resilient flexible mat, so that the colorant is transferred to the upper surface of the mat, thereby creating marks that are characteristic of the golfer's swing.

14 Claims, 4 Drawing Sheets

(56) References Cited

U.S. PATENT DOCUMENTS

| | | | | |
|---|---|---|---|---|
| 2002/0091011 | A1* | 7/2002 | Sosin | A63B 69/3623 473/278 |
| 2003/0087708 | A1* | 5/2003 | Tiffin | A63B 69/3661 473/237 |
| 2003/0216189 | A1* | 11/2003 | Tiffin | A63B 69/3661 473/237 |
| 2006/0128493 | A1* | 6/2006 | Snopkowski | A63B 69/3661 473/278 |
| 2007/0298895 | A1 | 12/2007 | Nusbaum et al. | |
| 2008/0015044 | A1* | 1/2008 | Reich | A63B 69/3617 473/231 |
| 2008/0032811 | A1* | 2/2008 | Bearden | A63B 69/3661 473/278 |
| 2008/0085779 | A1* | 4/2008 | Nagai | A63B 53/047 473/226 |
| 2008/0096684 | A1* | 4/2008 | Lara | A63B 69/3661 473/278 |
| 2008/0200277 | A1* | 8/2008 | Mitchell | A63B 69/3661 473/270 |
| 2008/0293509 | A1* | 11/2008 | Lipidarov | A63B 57/10 473/278 |
| 2010/0216577 | A1* | 8/2010 | Jessup | A63B 69/3617 473/409 |
| 2014/0274438 | A1* | 9/2014 | Molinari | A63B 69/3617 473/237 |
| 2015/0196810 | A1* | 7/2015 | Griffes | A63B 69/3617 473/351 |

* cited by examiner

METHOD OF ANALYZING A GOLF SWING AND PRACTICE MAT

Information about a golfer's swing is generated when a golf ball is hit off of a resilient mat using a club having a temporary colorant applied to the sole of the club head. The colorant is transferred to the mat, indicating the path of the club head, the angle of the club head relative to the mat, and the point of contact relative to the ball.

BACKGROUND OF THE INVENTION

Myriad devices have been invented to assist golfers in improving the mechanics of their swing. One category of device employs a marker attached to the head of a golf club in combination with a sheet or mat to record the marks generated by swinging the club.

Swords—U.S. Pat. No. 3,687,459 discloses a pair of spaced apart scribers (pens) attached to the head of a club. The tracks of the scribers on a sheet indicate the nature of the golfer's swing.

Golden—U.S. Pat. No. 3,992,013 discloses a dust covered mat and a golf club, modified by attaching a device with protruding pegs to the club head. The attachment is capable of dispersing the dust, when the club contacts the mat.

Blaisdell—U.S. Pat. No. 4,932,662 discloses a club lie angle evaluator having a club whose lower surface has received an abradable coating. When the golf club comes into contact with the surface supporting the golf ball, the coating is abraded, indicating whether the lie angle of the club is appropriate for the particular golfer.

Cerami—U.S. Pat. No. 5,120,064 discloses a spring loaded marker attached to the head of a golf club. The marker traces lines on a sheet, indicating the path of the golf club.

Hsu—U.S. Pat. No. 5,620,376 discloses a marker attached to the shaft of a golf club, adjacent the club head. The marker has a chamber for holding a liquid and an orifice at the bottom. Swinging the club releases the liquid and creates a mark on the ground indicating the path of the golf club.

Another category of devices provide a removable recording medium attached to the face of a golf club. When a golf ball is struck, an impression is created in the medium. Examples of such devices are disclosed in Lee—U.S. Pat. No. 5,142,309 and Butler, Jr. —U.S. Pat. No. 5,609,530.

Yet another category of golf swing analysis aids include mats that indicate the swing path of a golf club.

Goduto—U.S. Pat. No. 3,815,923 discloses mats having fibers that are moved from a first position to a second position after being struck by the head of a golf club. The fibers are bicolored, so that the path of the club head will be readily apparent.

Tiffin—U.S. Pat. No. 6,913,544 B2 discloses a divot practice mat having a mark retaining surface, such as carbon paper or wax. Simulated golf balls are imprinted on the surface of the mat and provide a target for the golfer.

Snopkowski—US 2006/0128493 A1 discloses a synthetic turf practice mat having fibers that change visually in appearance after being struck with the head of a golf club. Alternatively, the mat may employ liquid applied to the fibers, sand, aluminum powder or magnetic powder, to visually identify the path of a club head.

Nusbaum et al. —US 2007/0298895 A1 disclose a golf swing analysis mat that has electronic sensors to detect the point of impact and path of a golf club head. A microcontroller analyzes the data and provides feedback to the golfer.

Mitchell—US 2008/0200277 A1 discloses a golf mat with grass-like blades that "toggle" from a forward face to a rearward face, after being struck by the head of a golf club. When the blades are toggled, they appear a different color.

SUMMARY OF THE INVENTION

Despite the proliferation of methods and apparatuses to assist golfers in improving their swing, there remains a need for a training device that is economical and easy to use, does not affect the swing of the golf club, does not result in permanent alteration or modification of the golf club, can be used with any golf club, can be used while hitting regulation golf balls or hollow practice balls, and provides three important characteristics of the golf club swing, namely (i) the path of the golf club head; (ii) the alignment of the sole of the club head relative to the mat; and (iii) the point of contact relative to the golf ball being hit.

The present invention includes a method of generating characteristic information about a golfer's swing, as well as a kit for use in practicing the method. Briefly, the method involves applying a colorant to the sole of a golf club and hitting golf balls off of a resilient, flexible mat, whereby the colorant from the sole of the club is transferred to the upper surface of the mat by sliding contact. The colorant and the mat are selected so that the colorant will create visible marks on the upper surface of the mat, which can be analyzed.

The method of the present invention is extremely versatile and can be used with virtually any golf club and with regulation golf balls or light-weight whiffle balls. Receptacles, such as indentations, are provided in the surface of the mat for holding a golf ball to be hit and serving as a marker for where the golf ball was positioned after it is hit. In various embodiments of the invention, the mat is provided with holes that extend through the mat, so that the golf balls can be placed over the holes, or can be hit from tees protruding from the surface of the mat.

Also within the scope of the invention is to apply multiple colors to the sole of the golf club to indicate whether the toe or heel of the club is striking the mat, rather than the entire sole of the club head. Alternatively, the colorant may be applied to only a portion of the sole of the golf club, for example, below the sweet spot, to determine where the ball is being struck relative to the desired location on the club head. Different colors may be applied to different golf clubs and used on the mat, to create a record indicative of how the golfer swings different clubs. The same club may be used to hit golf balls with first one colorant and then a second colorant, to gauge the effect that adjustments in the golfer's swing have during the course of practice.

The mat may be provided with an artificial turf backing, so that the mat can be flipped over for practice on a surface that closely simulates the fairway of a golf course. In another embodiment, the mat may be provided with a cushion backing, so that the mat may be used on a hard surface, such as the floor inside a building.

A kit for practicing the present invention contains one or more marking instruments and a mat having a smooth, flexible, resilient surface upon which the colorant is visible.

DETAILED DESCRIPTION OF THE INVENTION

Without limiting the scope of the invention, the preferred embodiments and features are hereinafter set forth. All of the United States patents that are cited in the specification are hereby incorporated by reference.

Information about a golfer's swing is generated by applying a colorant to the sole of a golf club head and the golfer using the golf club to hit the ball off of a resilient mat. The sole of the golf club slides across the surface of the mat and transfers the colorant to the mat, creating a pattern that is characteristic of the golfer's swing.

The term colorant is used broadly to describe a dye, pigment, ink or paint that when applied to a substrate changes its hue. The colorant can be conveniently provided in a marking instrument. By way of example, the marking instrument may be a liquid composition, wherein the colorant is dissolved or dispersed in a liquid, such as a felt-tip pen. The liquid composition may contain a volatile liquid, which evaporates when the composition is applied to a substrate, and a binder, which together with the colorant remains on the substrate. The marking instrument may also be a colorant dispersed in a solid matrix, such as a crayon having a colorant dispersed in wax, chalk or grease. The colorant may be a black pigment, such as carbon black.

Of particular interest for the present invention is the class of marking instruments identified as non-permanent markers. These markers include white board or dry-erasable markers, as well as water-washable markers sold under the Crayola® brand name and polymeric colorants offered by Milliken & Company, South Carolina, under the Creative Colorants™ brand name. In one embodiment of the invention, the colorant is water-washable, that is, it can be removed from the sole of the golf club or surface of the mat with an aqueous cleaning composition, such as water containing a minor amount of soap, detergent and/or of alcohol, such as a $C_1$-$C_6$ alkyl alcohol.

Figure 1:
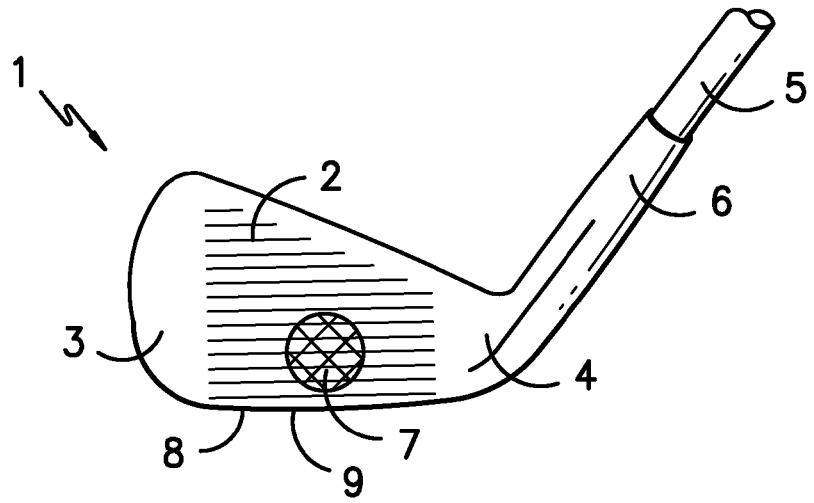
FIG. 1 is a side view of a typical golf club head.
Figure 2:
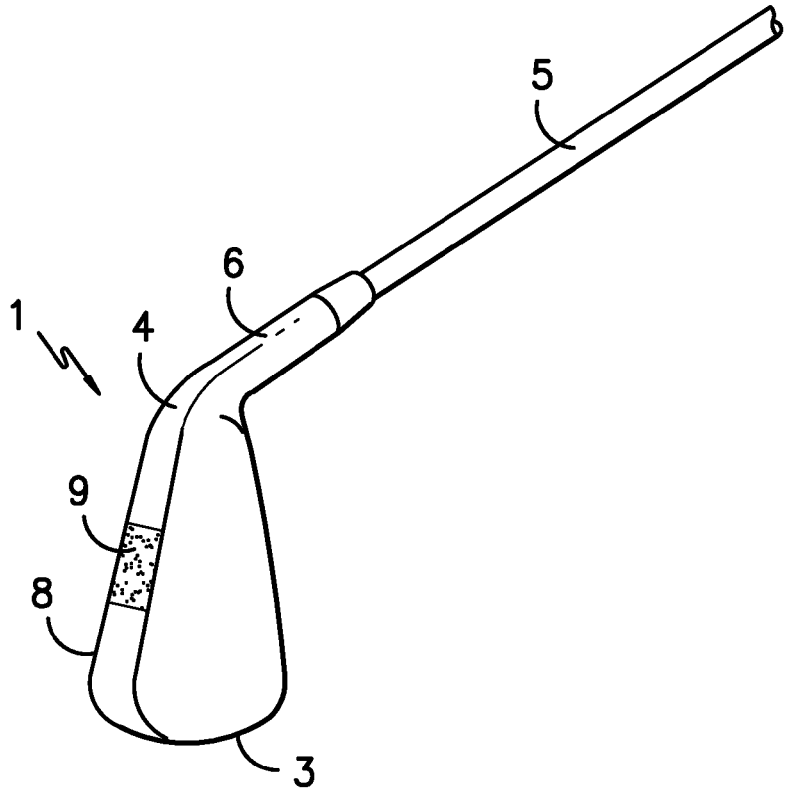
FIG. 2 is a perspective view of the bottom of the golf club head.

Referring to FIGS. 1 and 2, the head of a typical golf iron is shown. Golf club head 1 has face 2, toe 3 and heel 4. The shaft 5 of the club is inserted in hosel 6. The sweet spot 7 is the place in the middle of club face 2 and is the ideal spot to hit the golf ball. The sole 8 is the closest part of the club head to the ground and is aligned parallel to horizontal, when the golf club is held at the proper angle.

The colorant may be applied to the sole of a golf club head by a variety of methods, including with a marking instrument, pen or brush. The colorant may be applied to the entire length of sole 8 or any portion thereof. By way of example, the colorant may be applied only to a portion of the sole of the club head, (i) below the sweet spot; (ii) below the toe; or (iii) below the heel of the club. By way of further example, a portion of the sole marked with the colorant may be an area of ½ or less the length of the sole of the club or even ⅓ or less the length of the sole of the club. Accordingly, when a ball is hit off of the mat and the colorant is transferred to the surface of the mat it is possible to determine whether such portion of the sole of the club has struck the mat and where it has struck in relation to the golf ball.

In one embodiment of the invention, the colorant is applied to the sole only below sweet spot 7, as shown in FIG. 2 by area 9. For the purposes of the present invention, the portion of the sole below the sweet spot 7 is defined as an area of 1 inch in length or less, where colorant has been applied to the sole, and at least a portion of such area is positioned below the middle of the club face.

In another embodiment of the invention, two or more colorants having different hues are applied to the sole of the same club head, in different locations along the length of the sole. For example, one colorant could be applied beneath the toe, a second colorant applied beneath the sweet spot, and a third colorant applied beneath the heel of the club. When the club is used to hit a ball off of the mat, the color pattern transferred to the mat will indicate whether the toe, heel or all of the sole is striking the mat.

The present invention can be practiced with any golf club that is swung, including woods, regardless of whether they are made of wood, titanium or other metal or combination thereof, hybrids, irons, wedges or chippers.

Figure 3:
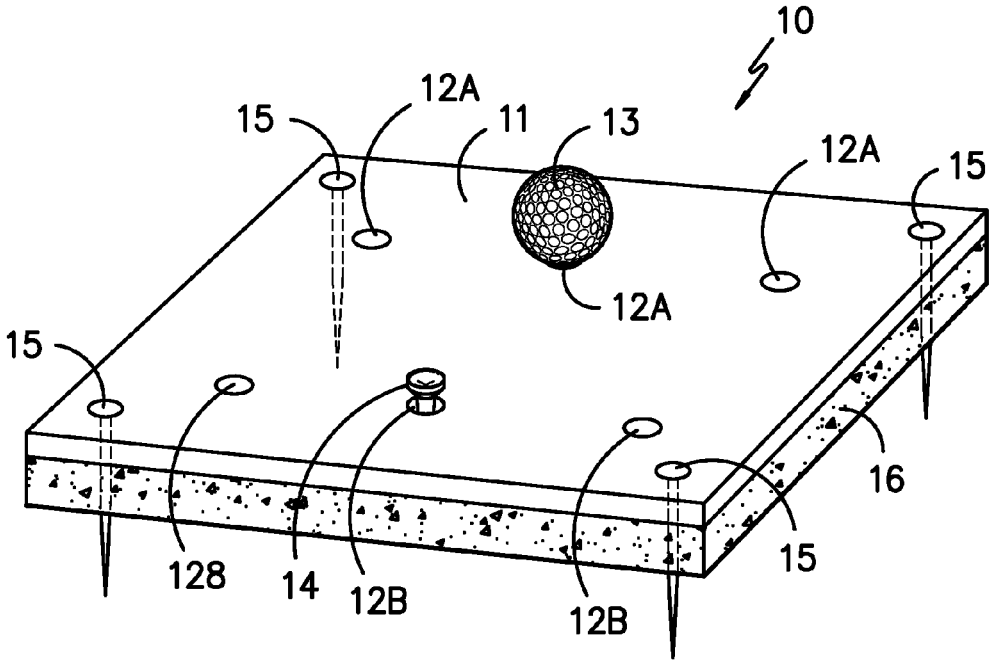
FIG. 3 is a perspective view of a mat with a cushion backing.

Referring to FIG. 3, mat 10 has an upper surface 11, with a plurality of spaced-apart receptacles 12A and 12B, for holding golf ball 13. The present invention may be used with regulation golf balls, or practice balls, such as whiffle balls or solid, hollow plastic balls. The receptacles can be a depression in the upper surface 11, such as receptacles 12A, or a hole extending through mat 3, such as receptacles 12B. Golf tee 14 may be inserted through one of receptacles 12B, for practicing hitting golf balls off of a tee, for example, with a wood.

Upper surface 11 is a flexible, resilient sheet, which can withstand repeating striking with a vigorously swung golf club, without the mat deforming or the sole of the golf club being marred. Upper surface 11 has a relatively low coefficient of friction, so that is does not hinder the swing of the club. The colorant and material for upper surface 11 should be compatible, such that the colorant can be readily transferred to the upper surface, when the sole of the golf club is in sliding contact with the upper surface. Furthermore, the hue of the colorant and the upper surface 11 should provide sufficient contrast so that the colorant is readily visible. By way of example, upper surface 11 may be colored white, off-white or a light shade of gray.

Suitable materials of construction for upper surface 11 include polymers, especially fiber reinforced polymers. By way of example, the materials may be selected from polyolefin, nylon, polyester and polytetrafluoroethylene polymers as the matrix material. The matrix material may have fibers dispersed or aligned therein or a scrim may be provided in the matrix. Of particular utility are polymeric roofing membranes. By way of example, the roofing membrane may be a thermoplastic polyolefin having a fiberglass or polyester fiber scrim embedded therein. Roofing membranes having a thickness of 30 to 90 mils (1 mil=1/1,000 inch) are available and may be used.

Mat 10 may be held in place during practice by inserting stakes 15 into the ground. Also within the scope of the invention is to provide mat 10 with a rigid or semi-rigid frame, which will keep mat 10 flat during use. The downward facing part of the frame, that is the part in contact with the ground, may be provided with a non-slip mechanism. Depending upon the application, the non-slip mechanism may be teeth or protrusions for engaging turf or soil, or a high-coefficient of friction material, such as a coating of rubber, for engaging a flat surface.

In one embodiment of the invention, mat 10 is provided with a cushion backing 16, which may be attached to upper surface 11 by a suitable adhesive, including hot-melt adhesive, laminating film, or cushion backing 16 may be formed in situ. Suitable materials for cushion backing 16 include polymer foams, such as polyurethane foam, and natural and synthetic elastomers. Cushion backing 16 stabilizes upper surface 11 and, depending on the weight and stiffness of backing 16, may obviate the need for stakes or a frame to keep mat 10 in place during use. Cushion backing 16 is particularly useful when the invention is practiced indoors, such as hitting whiffle balls in a garage having a concrete floor.

Figure 4:
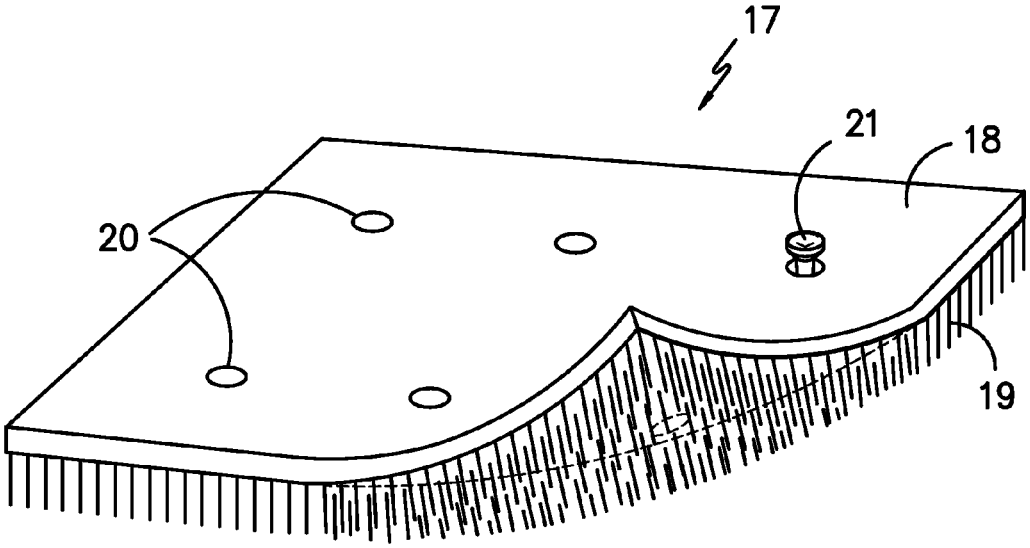
FIG. 4 is a perspective view of a mat with an artificial turf backing.

In another embodiment of the invention, the mat is provided with a smooth, upper surface, upon which the colorant will be transferred during practice swings, and an artificial turf backing, which both cushions upper surface 18 and can be used as a practice surface, when the mat is reversed. Referring to FIG. 4, mat 17 has a smooth, continuous upper surface 18 and an artificial turf backing 19. Holes 20 extend through mat 17 and serve as receptacles on upper surface 18 to set a golf ball, or tee 21 can be inserted through any of holes 20.

Artificial turf is an arrangement of relatively coarse synthetic fibers designed to simulate grass found in the fairway of a golf course. By way of example, the fibers may extend from a backing to create a pile surface, or the backing may be a porous, non-woven mat formed by extruding a thermoplastic polymer through multiple nozzles to form a mat in situ, or by needle-punching staple fibers and binding the fibers in the form of a mat. For aesthetics and to avoid showing the colorant applied to the sole of the golf club, artificial turf backing 19 may be a deep shade of green.

Figure 5:
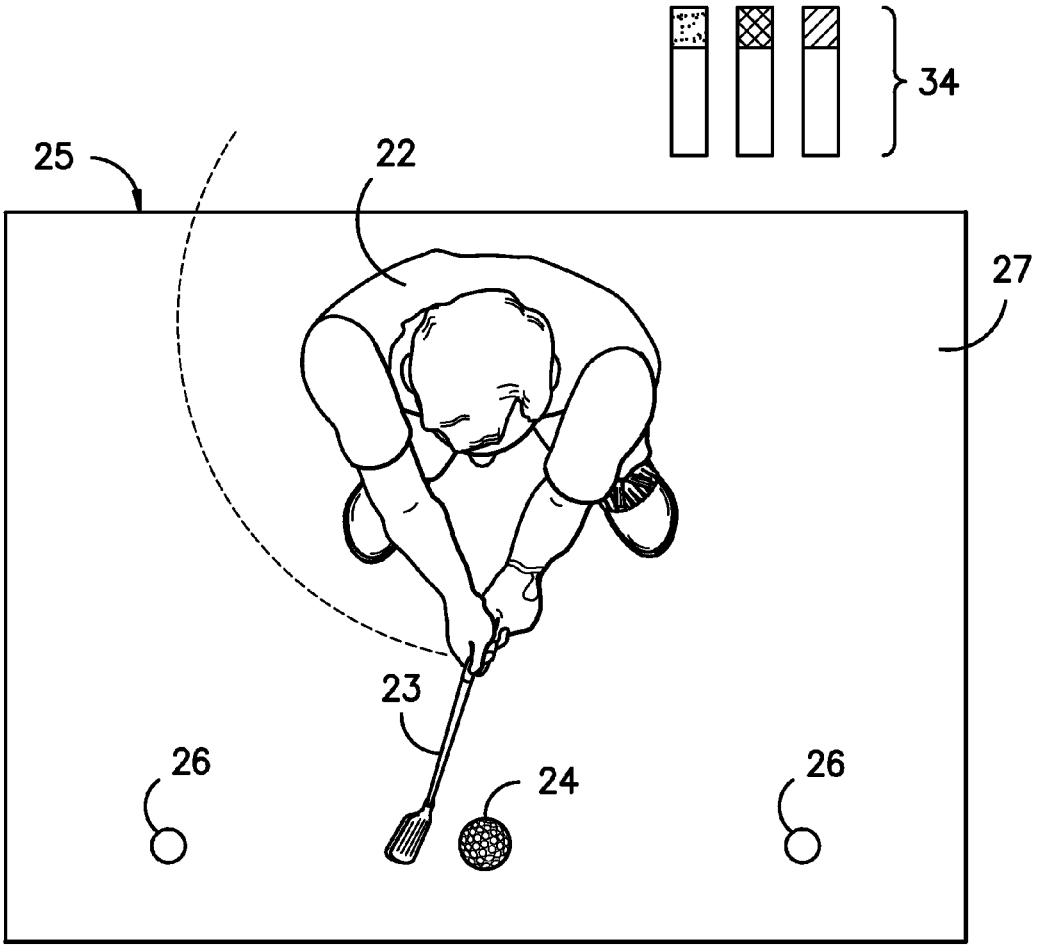
FIG. 5 is a top view of a golfer practicing on a mat.
Figure 6:
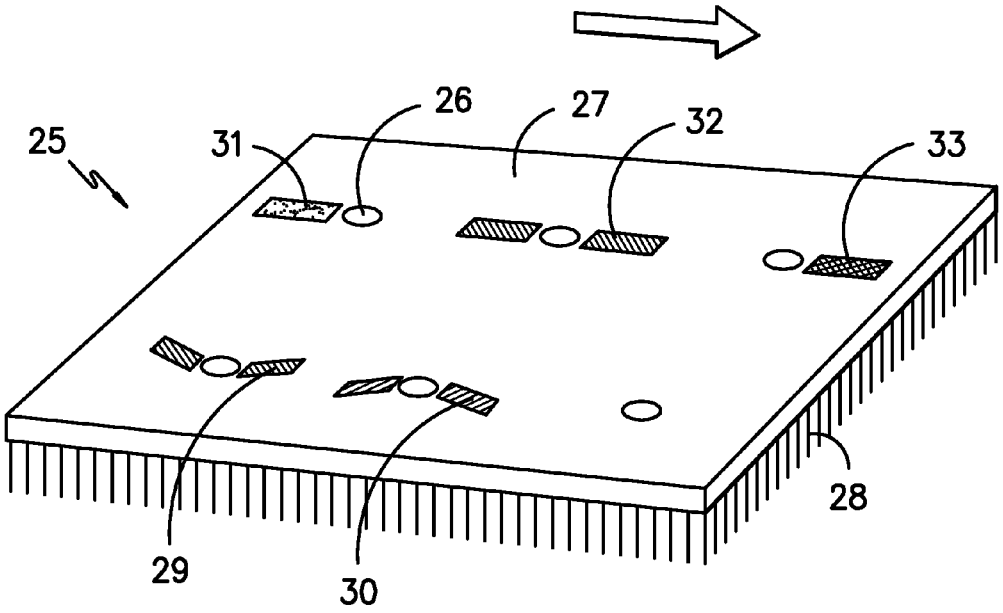
FIG. 6 is a perspective view of the mat bearing colorant marks characteristic of the golfer's swing.

Referring to FIGS. 5 and 6, a golfer 22 is shown swinging golf club 23, to hit golf ball 24 off of mat 25. Golf ball 24 is positioned in receptacle 26 in the upper surface 27 of mat 25, or if desired, on a tee protruding from the surface of the mat. Prior to hitting golf ball 24, colorant has been applied to the sole of golf club 23. Accordingly, when golf ball 24 is hit, the sole of the golf club will slide across upper surface 27 and transfer the colorant to the upper surface of the mat.

In one embodiment of the invention, after one or more golf balls have been hit off of mat 25, a second colorant may be applied to the sole of golf club 23 and more golf balls can be hit off of the mat. By using a second colorant, the golfer can observe whether subsequent adjustments to his/her swing have changed the characteristics of the golf swing.

In another embodiment of the invention, the golfer selects a second golf club and applies a second colorant to the sole of that club, prior to hitting one or more golf balls off of the mat. The golfer can than readily compare the swing characteristics of one club with another by comparing the different colors transferred to the mat, which will be characteristic of the golfer's swing with each club. The golfer may move the position of the golf balls to various receptacles on the mat, during the course of practice, to create a new pattern of streaks on the mat.

During the course of practice, the golfer may want to hit golf balls off of a surface that more closely simulates the conditions of the fairway of a golf course. The method of the present invention includes flipping mat 24 over, to access an artificial turf backing 28, such as shown in FIG. 6.

At the end of practice, the upper surface of mat 25 will have colorant transferred thereon in patterns characteristic of the golfer's swing. For example, mark 29 indicates a swing that is outward-to-inward, mark 30 indicates a swing that is inward-to-outward, mark 31 indicates a swing that is too far behind the ball, mark 32 indicates an ideal golf swing and mark 33 indicates a swing the is too far in front of the ball.

After the available areas on the mat have been filled with streaks of color and analyzed by the golfer, the colorant can be wiped from the upper surface of the mat, if necessary, with the aid of an aqueous cleaning composition.

The present invention also includes a kit for practicing the subject method. Referring to FIGS. 5 and 6, a plurality of marking instruments 34 are provided along with mat 25. The marking instruments 34 can be used to apply a colorant to the sole of golf club 23, and the colorant is transferable to the smooth, upper surface 27 of mat 25 upon frictional contact between the sole of the golf club and the mat.

The mat used in the present invention may be provided in a variety of shapes and sizes. By way of example, the mat may range in size from 1 $ft^2$ to 25 $ft^2$, in particular, from 3 $ft^2$ to 15 $ft^2$.

There are, of course, many alternative embodiments and modifications intended to be included within the scope of the following claims.

What I claim is:

1. A method of recording characteristics of the swing of a golf club, comprising the steps of:

(a) applying a colorant to the sole of the golf club;

(b) providing a resilient mat having an upper surface on which the colorant is visible;

(c) placing a golf ball on the upper surface of the mat or on a tee protruding from the upper surface of the mat; and (d) hitting the golf ball with the golf club, such that the sole of the golf club is in sliding contact with the upper surface of the mat and transferring the colorant to the upper surface.

2. The method of claim 1, wherein the colorant is only applied to the sole of the golf club below the sweet spot.

3. The method of claim 1, further comprising the steps of (i) removing the colorant from the sole of the golf club and applying a second colorant to the sole of the golf club; (ii) placing a second golf ball on the mat or on a tee protruding from the upper surface of the mat; and (iii) hitting the second golf ball with the golf club, such that the sole of the golf club is in sliding contact with the upper surface of the mat and transferring the second colorant to the upper surface.

4. The method of claim 1, further comprising the steps of (i) selecting a second golf club for practice and applying a second colorant to the sole of the second golf club; (ii) placing a second golf ball on the mat or on a tee protruding from the upper surface of the mat; and (iii) hitting the second golf ball with the second golf club, such that the sole of the second golf club is in sliding contact with the upper surface of the mat and transferring the second colorant to the upper surface.

5. The method of claim 1, wherein the mat has a plurality of receptacles on the upper surface in which golf balls can be placed.

6. The method of claim 5, wherein the receptacles are holes extending through the mat.

7. The method of claim 6, wherein the tee is placed in one of the holes and the golf ball is hit off of the tee.

8. The method of claim 1, wherein the colorant is water-washable and further comprising the step of removing the colorant from the upper surface of the mat by washing the upper surface with an aqueous cleaning composition.

9. The method of claim 1, wherein two colorants, each having a different hue, are applied to the sole of the golf club in different locations along the length of the sole.

10. A method of recording characteristics of the swing of a golf club, comprising the steps of:

(a) applying a colorant to the sole of the golf club;

(b) providing a resilient mat having a smooth surface on which the colorant is visible and a simulated grass surface on the opposite side of the smooth surface;

(c) placing a golf ball on the smooth surface of the mat or on a tee protruding from the smooth surface of the mat;

(d) hitting the golf ball with the golf club, such that the sole of the golf club is in sliding contact with the smooth surface of the mat and transferring the colorant to the smooth surface;

(e) turning the mat over;

(f) placing a second golf ball on the simulated grass surface of the mat; and (g) hitting the second golf ball with the golf club off of the simulated grass surface of the mat.

11. The method of claim 10, wherein the colorant is only applied to the sole of the golf club below the sweet spot.

12. The method of claim 10, wherein the mat has a plurality of receptacles on the smooth surface in which golf balls can be placed.

13. The method of claim 10, wherein two colorants, each having a different hue, are applied to the sole of the golf club in different locations along the length of the sole.

14. The method of claim 10, wherein the colorant is water-washable and further comprising the step of removing the colorant from the smooth surface of the mat by washing the smooth surface with an aqueous cleaning composition.

* * * * *